United States Patent [19]

Jones

[11] Patent Number: 4,798,378

[45] Date of Patent: Jan. 17, 1989

[54] ROWING MACHINE

[76] Inventor: Robert S. Jones, 2943 North Hackett Ave., Milwaukee, Wis. 53211

[21] Appl. No.: 891,439

[22] Filed: Jul. 28, 1986

Related U.S. Application Data

[63] Continuation-in-part of Ser. No. 754,719, Jul. 15, 1985, abandoned.

[51] Int. Cl.[4] ..... A63B 69/06

[52] U.S. Cl. ..... 272/72; 310/105; 272/129

[58] Field of Search ..... 272/72, 73, 69, 129, 272/DIG. 6; 310/105; 73/379-381

[56] References Cited

U.S. PATENT DOCUMENTS

| | | | |
|---|---|---|---|
| 857,447 | 6/1907 | Cooper | 272/129 |
| 1,974,445 | 9/1934 | Calleson | 272/72 |
| 2,512,911 | 6/1950 | Benice | 272/72 |
| 2,725,231 | 11/1955 | Hoover | 272/72 |
| 3,442,131 | 5/1969 | Leyten | 73/379 |
| 3,555,326 | 1/1971 | Talebi et al. | 310/168 |
| 3,558,130 | 1/1971 | Anderson | 272/72 |
| 3,586,322 | 6/1971 | Kverneland | 272/72 |
| 4,047,715 | 9/1977 | Gjessing | 272/132 |
| 4,060,239 | 11/1977 | Pfleiderer et al. | 272/73 |
| 4,082,267 | 4/1978 | Flavell | 272/125 |
| 4,084,810 | 4/1978 | Forsman | 272/129 X |
| 4,396,188 | 8/1983 | Dreissigacker et al. | 272/72 |

FOREIGN PATENT DOCUMENTS

| | | | |
|---|---|---|---|
| 83817 | 6/1957 | Denmark . | |
| 743133 | 10/1943 | Fed. Rep. of Germany . | |
| 2830691 | 1/1980 | Fed. Rep. of Germany . | |
| 468973 | 2/1952 | Italy . | |
| 7706583 | 1/1979 | Sweden | 272/72 |
| 371950 | 10/1970 | U.S.S.R. | 272/72 |
| 869781 | 10/1981 | U.S.S.R. | 272/72 |

OTHER PUBLICATIONS

F. G. Benedict & W. G. Cady, "A Bicycle Ergometer With An Electric Brake", Carnegie Institution of Washington, Publ. No. 167, 1912.

A. Krogh, "A Bicycle Ergometer and Respiration Apparatus For The Experimental Study of Muscular Work", Skand. Arch. Physiol. 33, pp. 375-394, 1913.

C. Lanooy & F. H. Bonjer, "A Hyperbolic Ergometer For Cycling & Cranking", J. Appl. Physiol. vol. 9, pp. 499-500, 1956.

J. Y. Harrison, "A Constant-Torque Brake For Use In Bicycle and Other Ergometers", J. Appl. Physiol., vol. 23, No. 6, pp. 989-993, Dec. 1967.

*Primary Examiner*—Richard J. Apley
*Assistant Examiner*—J. Welsh
*Attorney, Agent, or Firm*—Quarles & Brady

[57] ABSTRACT

A rowing exercise machine has a horizontal tubular member on which a seat is mounted on rollers for movement along the member. The horizontal member also mounts foot rests which may be removable. A flywheel assembly is mounted either at the front or rear end of the horizontal member. The flywheel assembly includes a flywheel and a one-way clutch connected to the flywheel. The flywheel is rotated by a user pulling on a handle which is connected by cables, chains or toothed belts to sprockets connected to the flywheel through the one-way clutch. The handle, cable or chain is attached to a slide that moves within the horizontal member and a tension cord is also connected to the slide to urge the handle through a retracted position. The clutch is disengaged when the handle retracts. The flywheel has a non-magnetic, conducting rim portion that passes through a magnetic field created by a stationary field piece having one or more field coils. Switches are actuated by the movement of the slide block within the horizontal member to alternately open and close a circuit from a source of current to the field coil at various positions during a rowing stroke.

26 Claims, 6 Drawing Sheets

FIG. 10
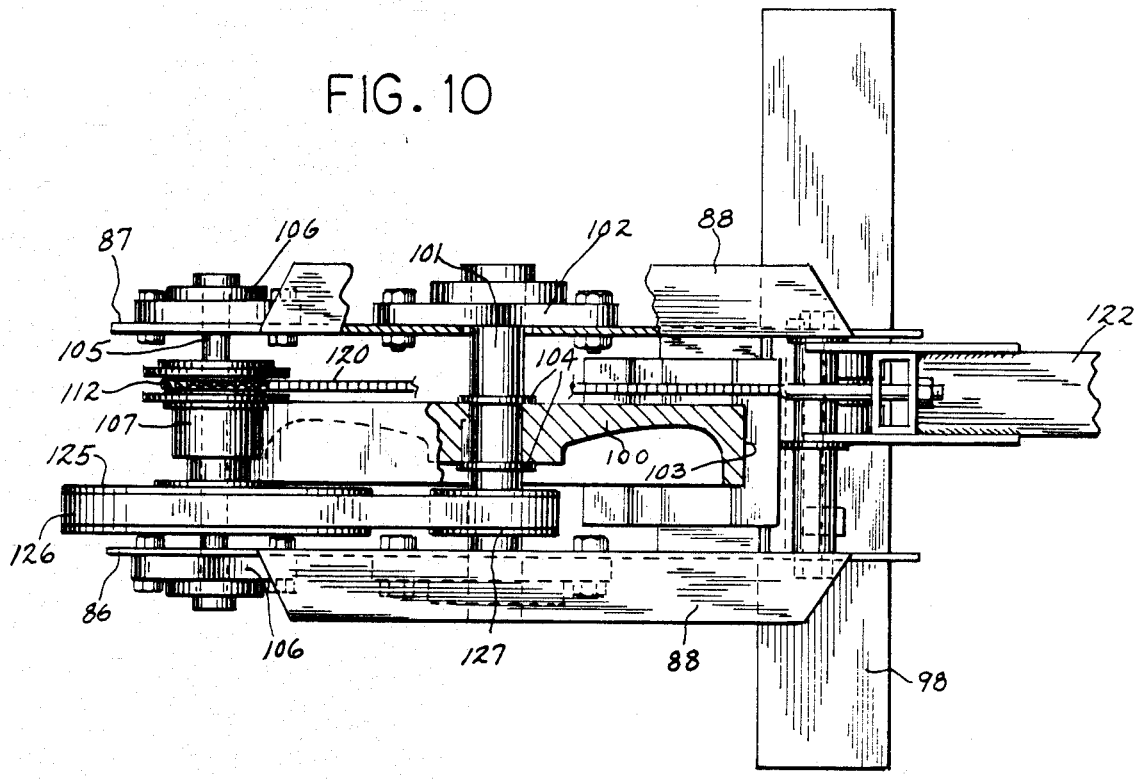
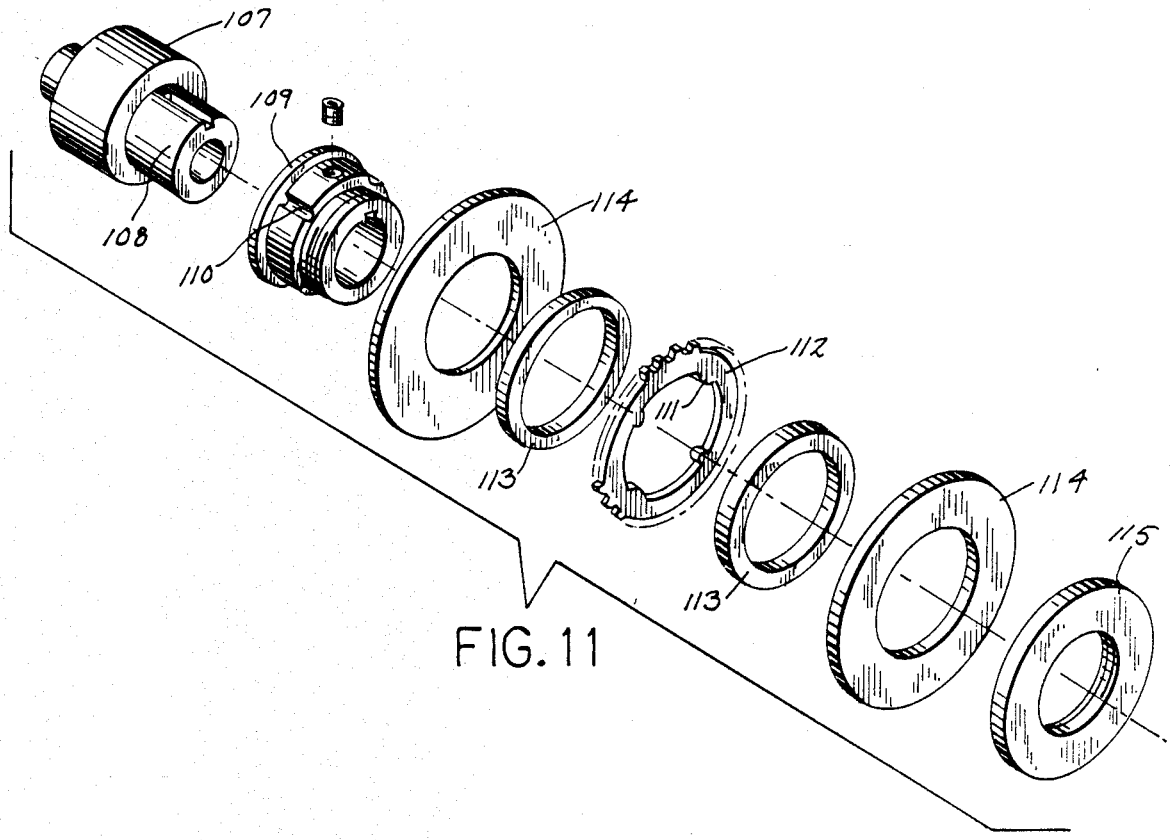
FIG. 11

ROWING MACHINE

RELATED APPLICATION

This application is a continuation-in-part of my copending application U.S. Ser. No. 754,719, filed July 15, 1985, now abandoned.

BACKGROUND OF THE INVENTION

This invention relates to exercise equipment, and particularly to a machine for exercising the muscles and practicing the skills that are used in rowing.

Rowing exercise machines are becoming very popular and commonplace. Most rowing machines use pneumatic cylinders to provide the resistance to a rowing stroke. The user sits upon a seat that slides back and forth along a rail, anchors his feet, and moves handles attached to the cylinder or cylinders. This type of rowing exercise machine provides a poor imitation of the actual body movements and muscle development that is needed for competitive rowing.

The standard against which all other rowing exercise machines have been measured is a machine of the type disclosed in U.S. Pat. No. 4,396,188 issued Aug. 2, 1983 to Dreissigacker, et al. In that device, a large flywheel having a plurality of fan-like blades is rotated as the user pulls on a chain attached to a handle. The user exercises against the resistance of the blades moving rapidly through the air, and work is also done in accelerating the flywheel. The wheel is mounted on a drive shaft that also mounts a one-way clutch with a sprocket engaged by the chain. The wheel can thereby rotate freely when the chain is retracted toward the wheel in preparation for the next pulling stroke.

Another recent addition to rowing exercise machines employs a drive wheel which is rotated by a nylon strap pulled by the rower. The drive wheel is connected by a belt to an alternator. The rower works to create an electrical current that is largely dissipated in a power resistor. However, during a stroke the resistence will decline noticeably apparently because the speed of the drive wheel will have increased to the point where armature reaction overcomes the resisting forces.

This same phenomenon of decreasing resistence after the flywheel speed has reached a particular level is associated with eddy-current brakes which have been used to provide resistance in bicycle exercise machines. The phenomenon has not proven to be a problem in such machines because the speed of the bicycle wheel typically never approaches the critical level. The phenomenon has, however, pointed away from the use of eddy-current brakes to provide the resistance in a rowing machine because of the need for a much higher flywheel speed in such machines.

I have developed a rowing exercise machine that provides a move nearly true simulation of the resistances encountered in rowing than any of the approaches previously. At the same time, the rowing exerciser is compact, portable and safe in its operation and construction.

SUMMARY OF THE INVENTION

In accordance with the invention, a rowing exerciser has a horizontal frame with a seat mounted for movement along the frame, foot rests, a rotatable flywheel, handle means for rotating the flywheel, and an eddy current brake coupled to the flywheel to resist rotation of the flywheel.

Further in accordance with the invention, a rowing exerciser has a horizontal frame with a seat mounted for movement along the frame, a flywheel rotatably mounted adjacent either the front or the rear of the frame and having a non-magnetic, conducting rim, means for creating a magnetic field at a position adjacent the flywheel rim, handle means for rotating the flywheel through the magnetic field, and a drive connecting the handle means to the flywheel.

In one preferred embodiment, the flywheel, handle means, drive means and means for creating the magnetic field are all mounted in a housing that is attached to the front of the frame. The attachment is through an adjustable and pivotal connection so that the height at which the handle can operate is adjustable. The means for creating the magnetic field comprises a field member with a coil. The field member has poles that confront the rim of the flywheel and are spaced a slight distance from the rim. The rotation of the rim through the magnetic field generates eddy currents in the rim that are attracted to the poles of the field member thereby producing a torque that tends to brake the flywheel. The strength of the magnetic field can be adjusted to thereby adjust the amount of the braking or retarding torque.

The handle may be attached to a chain that drives a drive shaft that is in turn connected to the flywheel shaft by a chain or timing belt. A one-way clutch is mounted on the drive shaft or flywheel shaft so that only a pulling motion of the handle will cause the flywheel to be driven and the flywheel will free wheel, subject to the resistance of the eddy-current brake, during the retraction of the handle. Means are provided to urge the handle to a retracted position.

In accordance with another preferred embodiment of the invention, the handle is attached to a cable which passes over upper and lower pulleys at the front of the frame. The cable passes through and along the length of the frame and connects to a chain that passes around a sprocket on a flywheel shaft mounted at the rear of the frame. The flywheel shaft mounts a one-way clutch connected to the flywheel which is also at the rear of the frame. The height of the upper pulley is adjustable to vary the handle height.

It is an object of the invention to provide a rowing exerciser that closely simulates the resistance encountered in rowing in water.

It is another object of the invention to provide a rowing exerciser that is compact and with a flywheel of a size that can be readily enclosed.

It is another object of the invention to provide a rowing exerciser that is adjustable to the body size of the user, and also adjustable to vary the resistance encountered during the overall stroke.

The foregoing and other objects of the invention will appear in the following detailed description. In the description reference is made to the accompanying drawings which illustrate preferred embodiments of the invention.

BRIEF DESCRIPTION OF THE DRAWINGS

FIG. 10 is a top plan view of the flywheel mechanism of FIG. 9;

FIG. 11 is an exploded view in perspective of the sprocket and one-way clutch assembly of the drive shaft of the second embodiment;

DETAILED DESCRIPTION OF THE PREFERRED EMBODIMENTS

Figure 1:
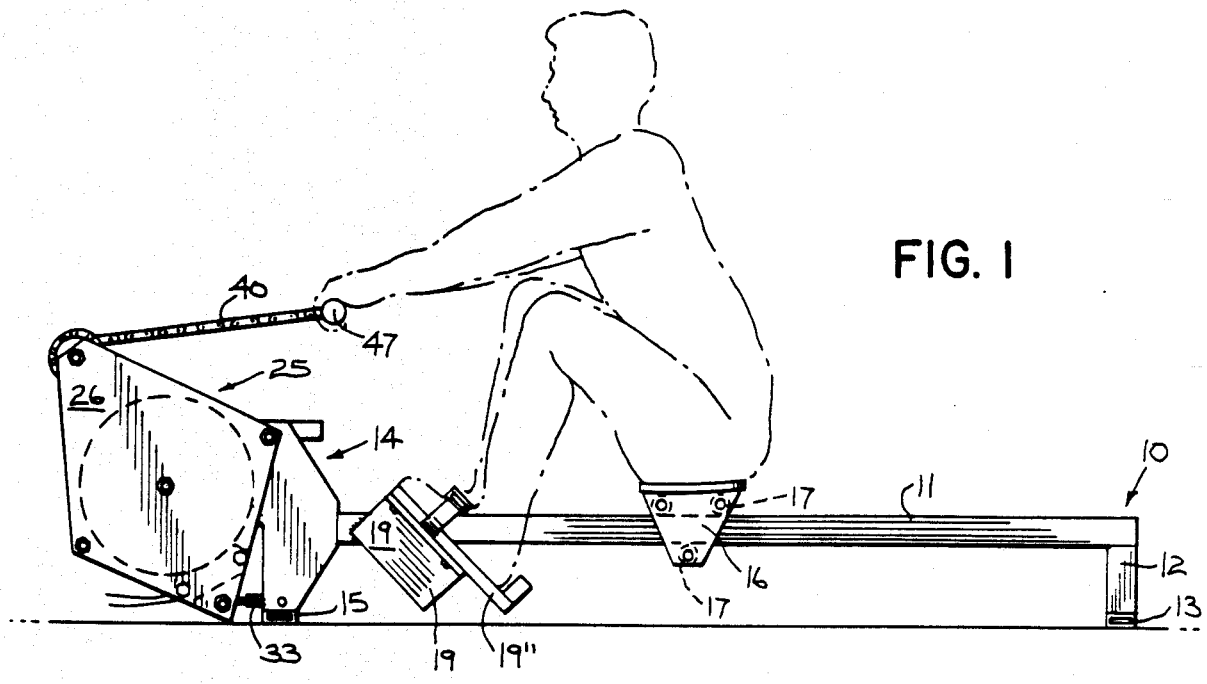
FIG. 1 is a view in elevation of a first embodiment of a rowing exerciser according to the invention.
Figure 2:
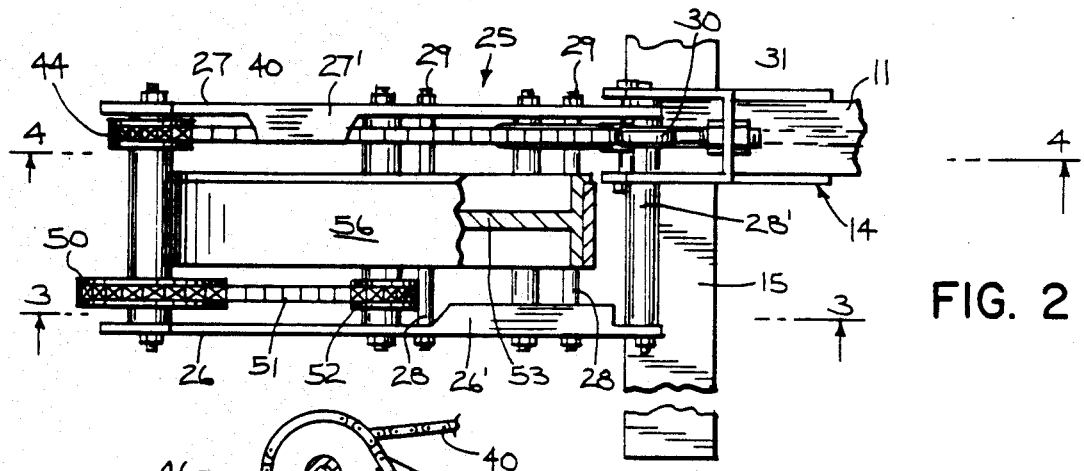
FIG. 2 is a top plan view of the flywheel mechanism of the machine of FIG. 1 and drawn to an enlarged scale.
Figure 3:
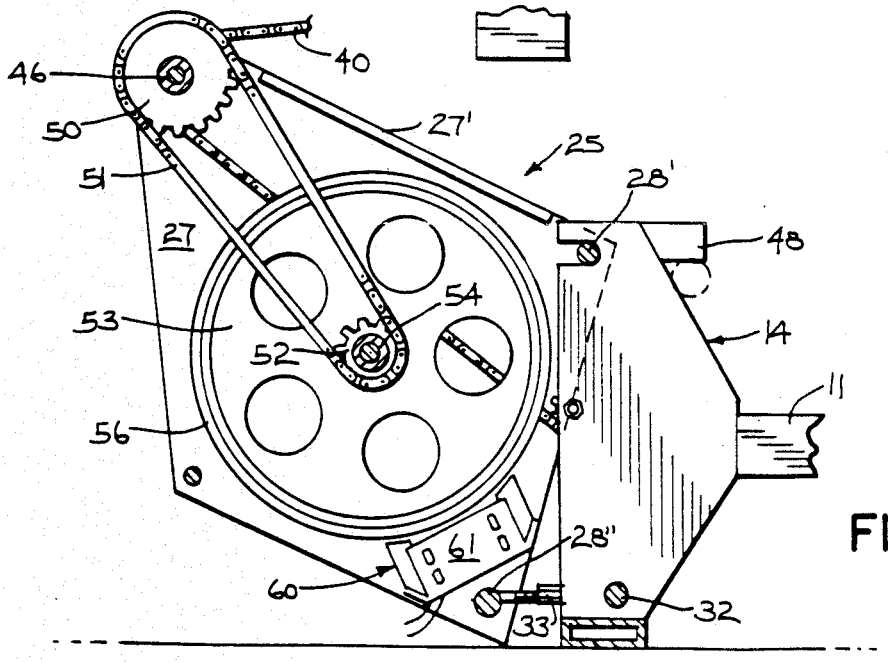
FIG. 3 is a view in vertical section taken in the plane of the line 3—3 of FIG. 2.

Referring to the first embodiment of FIG. 1, the rowing exerciser includes a frame identified generally by the reference numeral 10 that is comprised of a horizontal, longitudinal box member 11 supported at its rear on an upright standard 12 which in turn rests upon a transverse foot 13. The front of the horizontal member 11 is supported in a front bracket assembly 14 which also rests upon a transverse foot 15. A movable seat 16 is mounted about the horizontal member 11 with rollers 17 engaging the top and bottom of the horizontal member 11. Foot rests 19 and 20 are mounted on opposite sides of the horizontal member 11 adjacent the front bracket assembly 14. The foot rests 19 and 20 each include an L-shaped metal bracket 19′ and 20′ upon which is screwed a wooden tread 19″ and 20″.

A flywheel assembly indicated generally by the numeral 25 is joined to the front bracket assembly 14. The flywheel assembly includes side plates 26 and 27 which are held in a spaced, parallel relationship by a series of spacer rods 28 the threaded ends of which mount nuts 29 that hold the spacer rods to the side plates 26 and 27. The side plates 26 and 27 each have an inwardly extending upper flange 26′ and 27′ to strengthen the side plates and to further enclose the flywheel mechanism. One of the spacer rods 28′ is disposed at the upper rear corner of the flywheel assembly 25 and is surrounded by the eyelet of a threaded eye bolt 30 to provide a pivot mounting. The eye bolt 30 is mounted in a cross bracket 31. Another spacer rod 28″ is disposed at the lower rear corner of the flywheel assembly 25 and is joined to a transverse rod 32 at the bottom of the front bracket assembly 14 by a linkage in the form of a turnbuckle 33.

Figures 4, 5, 6:
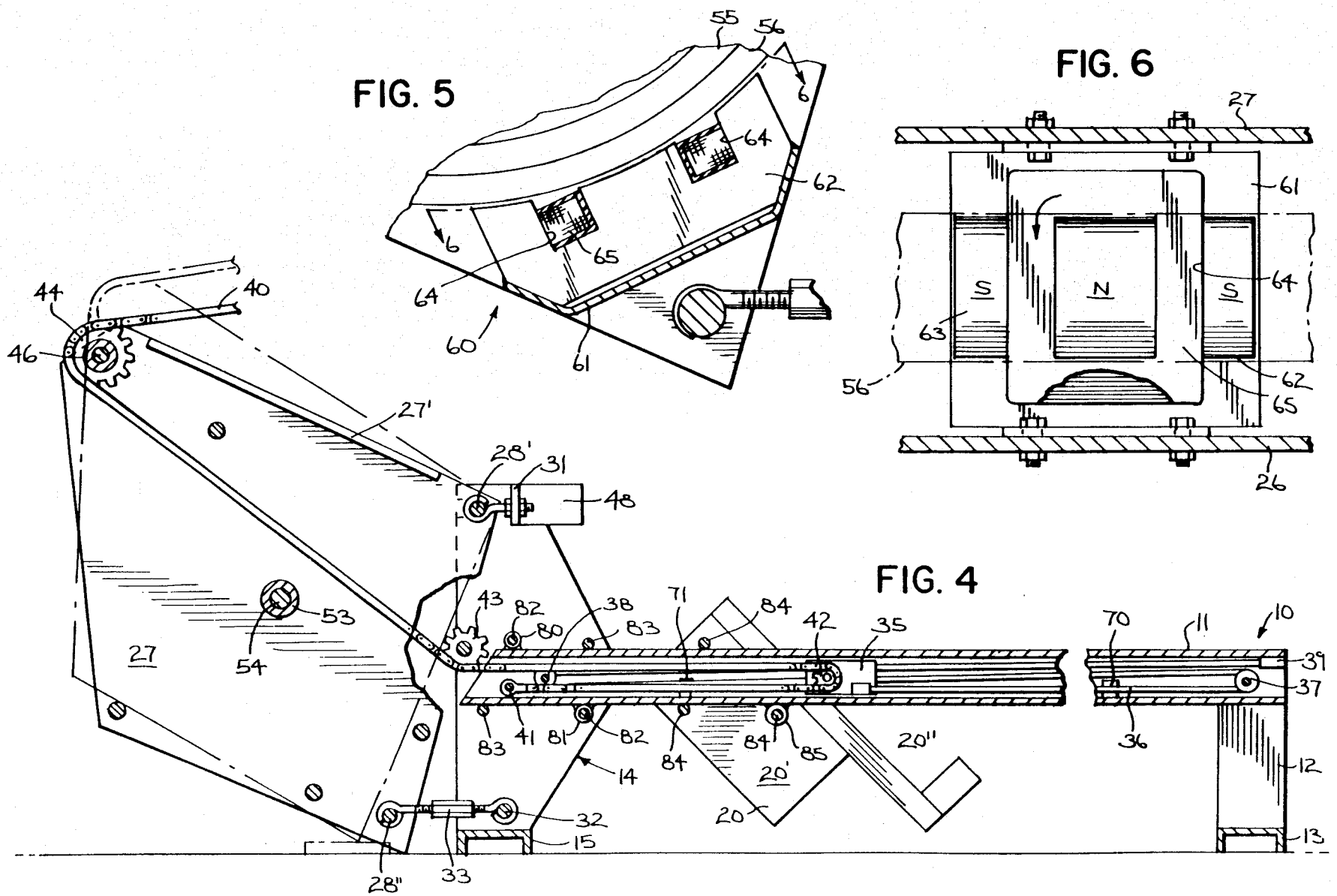
FIG. 4 is a view in vertical section taken in the plane of the line 4—4 of FIG. 2.
FIG. 5 is a side view in elevation of the field member and coil that generates the magnetic field through which the flywheel rotates.
FIG. 6 is a plan view of the field member and coil of FIG. 5 viewed in the plane of the line 6—6 of FIG. 5.

As shown in FIG. 4, a slide block 35 is disposed within the hollow interior of the horizontal member 11. The tension cord 36 extends from the rear pulley 37 to a forward pulley 38 and thence back to an anchor point 39 at the rear of the horizontal member 11. The slide block 35 is urged by the tension cord 36 to a position towards the rear of the horizontal member 11. A handle roller chain 40 is anchored within the horizontal member 11 at an anchor point 41 near the front of the member 11. The handle chain 40 extends from the anchor point 41 around an idler sprocket 42 mounted on the slide block 35, past an idler sprocket 43 journaled in the front bracket assembly 14 and then about a drive sprocket 44 mounted on a drive shaft 46 journaled in the side plates 26 and 27. The handle chain 40 terminates in a transverse handle 47 that is grasped by the user of the exerciser. When the user pulls upon the handle 47, the handle chain 40 will be extended thereby stretching the tension cord 36 so that, upon release of the pulling force on the handle by the user, the tension cord 36 will cause the slide block 35 to withdraw rearwardly within the horizontal member 11 and the handle 47 will be moved towards the drive sprocket 44. The handle 47 can be stored when not in use beneath projections 48 of the cross bracket 31 of the front bracket assembly 14.

The drive shaft 46 mounts a further sprocket 50 that is connected by a drive chain 51 to a bicycle free wheel 52 attached to a flywheel 53 mounted on bearings (not shown) that are mounted on a shaft 54 held at its ends in the side plates 26 and 27. The free wheel 52 functions as a one-way clutch that connects the flywheel 53 to the drive shaft 46 when the handle chain 40 is extended by the user and to disconnect The flywheel 53 mounts a separate rim 56 formed of the flywheel 53 when the handle is retracted. a conductive, non-magnetic material, such as a dynamo steel having the following composition:

Carbon: 0.12% Max.
Manganese: 0.20% Max.
Silicon: 0.60% Max.
Sulfur: 0.40% Max.
Phosphorus: 0.04% Max.
Nickel: Residual (0.15% Max.)
Chromium: Residual (0.15% Max.)
Vanadium: Residual (0.10% Max.)
Molybdenum: Residual (0.15% Max.)
Aluminum: 0.05% max.
All other elements to be held at residual levels (0.10% Max. for any one element, and a 0.40% total).

Figure 7:
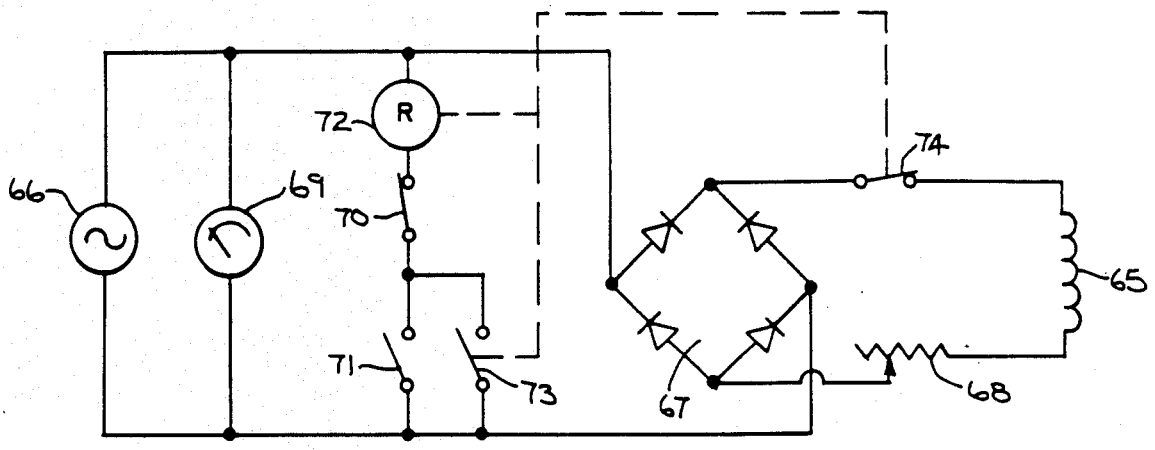
FIG. 7 is a schematic diagram of an electrical system for the rowing exerciser.

A magnetic field generator indicated generally by the reference numeral 60 is mounted on a bracket 61 bolted in place between the side plates 26 and 27 near the outer periphery of the rim 56. The magnetic field generator 60 includes a field member 62 formed from a stack of laminate plates. The field member 62 has a curved surface 63 with spaced notches 64 that receive a field coil 65 (see FIGS. 5 and 6). The notches 64 divide the curved surface 63 into three poles that confront the rim 56 and are closely spaced therefrom. As shown in FIG. 7, current may be supplied from an alternating current source 66 that is converted to direct current by a bridge rectifier 67 connected to the coil 65 in series with a variable resistor 68. An amp meter 69 gives a visual indication of the current flowing through the field coil 65.

If the current direction through the coil 65 is assumed as being counterclockwise as viewed in FIG. 6, the poles of the field member 62 will be aligned as illustrated in that drawing. Rotation of the flyweel 53 by the user pulling on the handle 47 will rotate the rim 56 through the magnetic field produced by the stationary field coil 65 with the result that eddy currents will be generated in the rim 56. A magnetic attraction between these eddy currents and the poles of the field member 62 will produce a braking torque on the flywheel 53 and it is this braking torque that provides the resistance against which the user of the equipment operates.

The resisting braking torque will increase with the current and with the speed of the flywheel. Thus, the amount of resistance can be adjusted by varying the current flow through the coil by adjusting the variable resistor 68. Furthermore, the user can increase the resistance by increasing the speed with which he manipulates the handle 47 and this is very similar to the increased resistance encountered by a rower as the hull of the boat meets increasing reisistance with increasing speed.

In use, the rower first typically draws his legs together thereby moving the seat 16 toward the front of the horizontal member 11. This also allows the handle 47 to reach its maximum forward position. This is the same position that a rower would assume at the catch of the oar in the water. The user then pulls the handle 47 by driving with his legs, levering his back, and pulling with his arms until he reaches a final rearward position corresponding to the release, at which the oar would be lifted from the water. During the stroke from catch to release, the resistance will increase because the speed of rotation of the flywheel 53 will increase. The user then allows the handle 47 to return forward as he would in carrying the oar back towards a position ready for the next catch. This is the recovery portion of the stroke. During this motion by the user, the flywheel 53 will continue to rotate because of the one-way clutch 45, but the flywheel will be slowed by the braking torque. The braking torque will be insufficient to stop the relatively heavy flywheel 53 during the short period of time represented by the recovery portion of the stroke. Thus, the flywheel 53 will not be moved from a dead stop and, just as in a boat, the subsequent strokes are made with the momentum of the flywheel (boat).

Because of the blade angle of the oar at catch and release, a significant percentage of the work a rower does while rowing a boat is spent moving water away from or toward the boat. This work is lost because it does not contribute to the acceleration of the mass of the boat and rower. This aspect of rowing a boat can be simulated on the rowing exerciser of this invention by having a higher torque at the catch and release than on other rowing machines. The user does the same amount of work as on other machines. However, because more of the work at catch and release is spent overcoming brake resistance, the flywheel acceleration will be less then on previous flywheel rowing machines. Therefore, in order that the flywheel be returned to the proper speed at the catch the braking torque during the recovery must be less than on previous flywheel rowing machines.

The braking torque on the free flywheel 53 during the recovery portion of the strokes can be varied by selectively applying current to the field coil 65. The limits of the handle movement at catch and release are reflected in the position of the slide block 35 within the horizontal member 11. A catch limit switch 70 is mounted within the horizontal member 11 towards the rear thereof and a release limit switch 71 is mounted towards the front of the horizontal member 11. The normally open release limit switch 71 is actuated by the slide block 35 to energize the coil 72 of a latching relay when the handle 47 has been extended to the limit of the power stroke. Energization of the latching relay coil 72 closes a latching contact 73 and also opens a normally closed contact 74 that opens the circuit to the field coil 65 thereby removing the braking torque. The normally closed catch limit switch 70 is activated by the slide block 35 before the handle 47 has been fuly retracted prior to the catch portion of the stroke. When the catch limit switch 70 is opened, the latching relay 72 is deenergized and the circuit to the field coil 65 is again completed.

Figure 8:
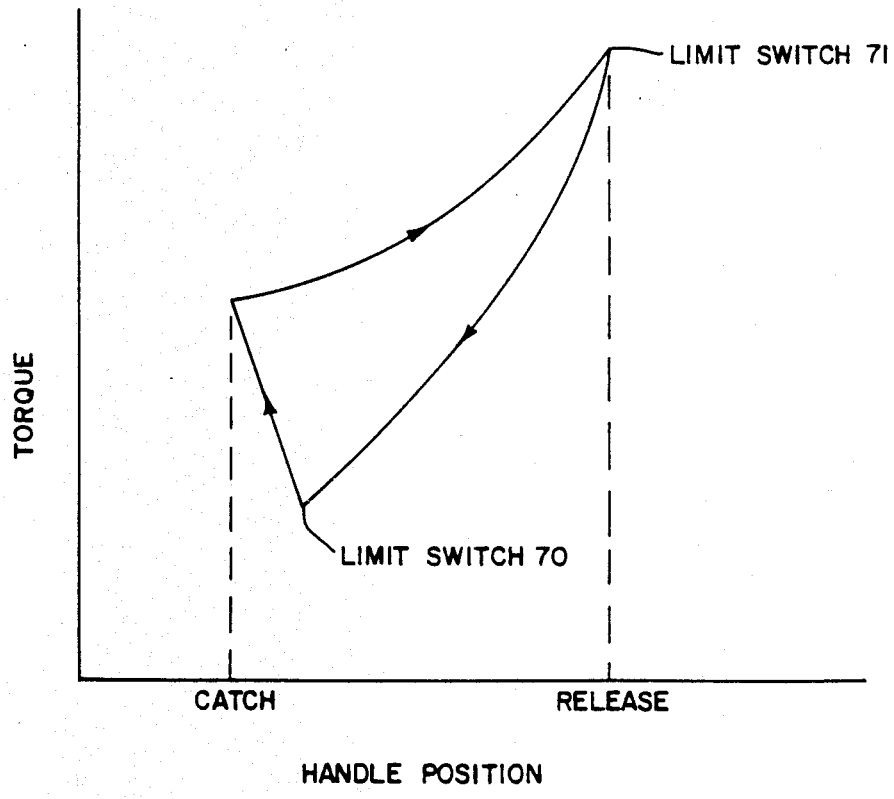
FIG. 8 is a chart of the retarding torque versus the handle position during a stroke and return of the rowing exerciser.
Figure 9:
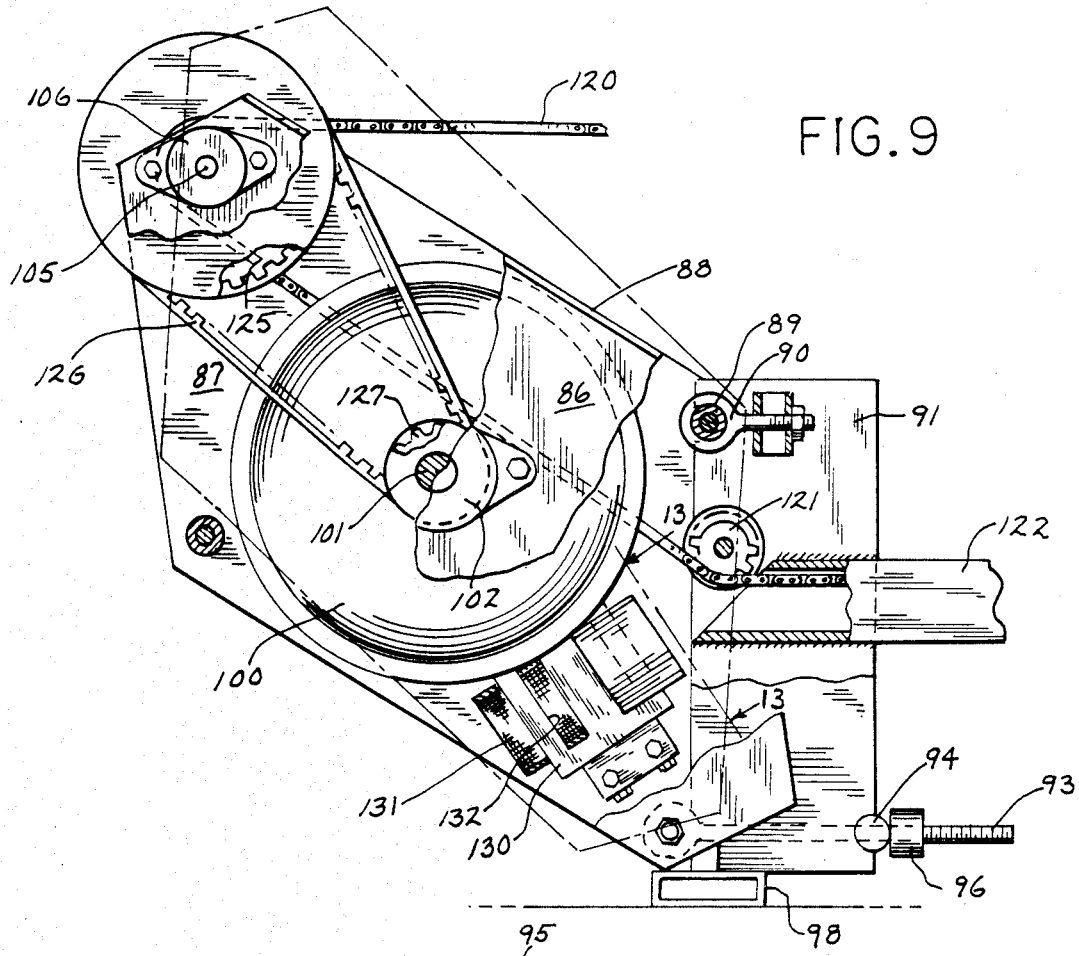
FIG. 9 is a view in elevation and partially in vertical section taken through the flywheel mechanism of a second embodiment of the invention.
Figure 12:
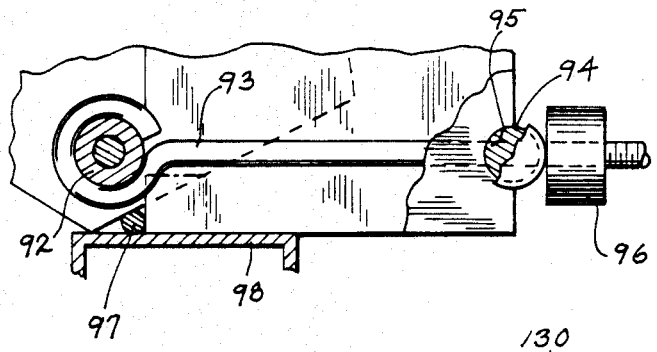
FIG. 12 is a view in vertical elevation of the pivot mounting for the flywheel mechanism of the second embodiment.
Figure 13:
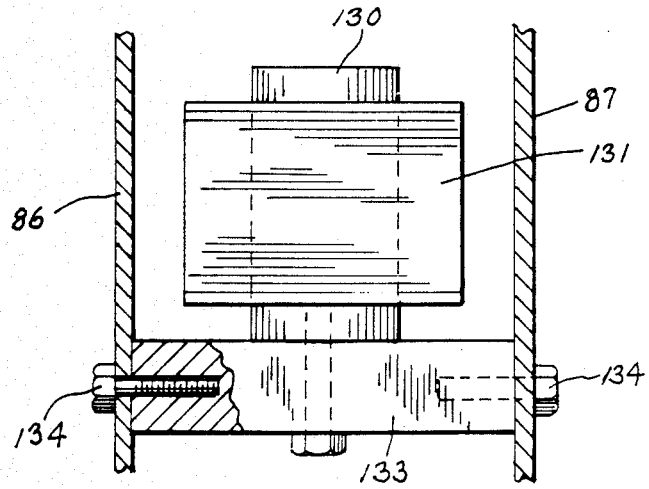
FIG. 13 is a view in elevation and partially in section of the field member and coil of FIG. 9 viewed in the plane of the line 13—13 of FIG. 9.

The effect of the function of the limit switches is illustrated in FIG. 8. In moving from a catch position to the release position, the torque increases solely as a function of increase in flywheel speed. When the release position is reached and the circuit to the field coil 65 is opened, the torque will decrease significantly as the flywheel 53 free wheels without braking torque until a position is reached that is nearly at the next catch. At that point the circuit is again completed to the field coil 65 and the braking torque will increase rapidly until it reaches the starting level at the next catch. If the circuit was maintained to the field coil 65 at all times, the torque would increase and decrease along the same line. The effect of the work done in moving water away from and toward the boat has never before been simulated in a rowing machine. As a result, rowers on a machine cannot get their muslces to work exactly as in a boat. The difference is significant and accounts for less than ideal training of the leg muscles and deterioration of rowing technique.

In rowing, the oars should be allowed to drop in the water of their own weight at the catch. From that instant, force should be applied to the handles in a very nearly linear path to the finish. Therefore, there is no downward force on the oar handles against which the rower must work. If the handle height is too lower in a rowing exercising machine, the rower cannot pull the handle straight back at the proper height without encountering a downward force on the handle. The rower tends to compensate for this by swinging his back and arcing the handle more than he would in a boat while sacrificing the straight back leg drive. To accommodate users of different height, the operating height of the handle 47 can be adjusted by raising and lowering the front sprocket 44. This is accomplished by pivoting the entire flywheel assembly 25 about the rod 28'. The turnbuckle 33 is adjusted to a length to hold the desired pivoted position of the flywheel assembly 25. The lower corner of the flywheel 25 can be blocked in an upwardly adjusted position as shown in FIG. 4.

The major components of the rowing exerciser can be disassembled for storage or transport. The front flywheel assembly 25 is removable from the front bracket assembly 14 by removing the eye bolt 30 and by removing the rear hook of the turnbuckle 33 from the rod 32. The front bracket assembly 14 is mounted to the horizontal member 11 in a manner that permits its disassembly. Specifically, as illustrated in FIG. 4, a pair of tubes 80 and 81 are welded to the top and bottom surfaces of the front end of the horizontal member 11. The tubes 80 and 81 receive through bolts 82 which are bolted to the sides of the front bracket assembly 14. An additional pair of through bolts 83 extend between the sides of the front bracket 14 and engage the top and bottom surfaces of the horizontal member 11. The foot rests 19 and 20 are similarly removably attached to the horizontal member 11 by through bolts 84 that connect the pair of foot rests 19 and 20 together. One of the through bolts 84 passes through a tube 85 welded to the bottom of the horizontal member 11.

The entire flywheel mechanism including the field piece and coil for providing the braking torque are compact in size and can be enclosed within a housing that protects the user from physical contact with the flywheel mechanism and also from the air currents that will be induced by the rotation of the flywheel.

Referring now to FIGS. 9–13, the second embodiment of the rowing machine is similar to that of the first embodiment except that it incorporates a modified flywheel mechanism. The flywheel mechanism includes a pair of identical side plates 86 and 87 having outwardly turned upper and lower flanges, exemplified by the upper flanges 88. As with the first embodiment, the side plates 86 and 87 are hinged on a spacer rod 89 which spans the side plates adjacent their upper rear corner and which is received in the eye of an eye bolt 90 that is mounted from a front bracket assembly 91. The lower rear corner of the side plates 86 and 87 also mount a spacer rod 92 which is received in the eye of an adjustable eye bolt 93 which passes through a grooved rod 94 that can pivot within a circular cut-out 95 at the bottom rear of the front bracket assembly 91. The threaded end of the eye bolt 93 mounts a nut 96 which bears against the rod 94. The position of the spacer rod 92 relative to the front bracket assembly 91 can be adjusted by lengthing or shortening the bolt 93. The flywheel mechanism is preferably held in an adjusted position by a rod 97 of an appropriate size disposed in the space defined by the bottom edges of the plates 86 and 87, the top of a front transverse foot 98, and the front edge of the front bracket assembly 91.

A flywheel 100 is keyed to a flywheel shaft 101 journaled at its ends in ball bearing assemblies 102 mounted in the side plates 86 and 87. Unlike the first embodiment, the flywheel 100 is formed entirely of a single casting of a non-magnetic, conductive material and has its outer rim surface 103 machined to a smooth diameter. Snap rings 104 axially restrain the flywheel 100 on the flywheel shaft 101.

A drive shaft 105 is also mounted between the plates 86 and 87 in ball bearings 106. The drive shaft 105 mounts a sprocket and one-way clutch assembly formed of a series of components that are illustrated in exploded perspective view in FIG. 11. The assembly includes a one-way clutch 107 keyed to the drive shaft 105. The clutch 107 includes an axially extending hub 108 on which is keyed a sprocket hub 109. The sprocket hub 109 has a series of spline recesses 110 which receive the splines 111 of a sprocket wheel 112. Spacers 113 are disposed on either side of the sprocket wheel 112 on the hub 109 and keeper plates 114 are mounted on the hub 109 outside of each spacer 113. The assembly of sprocket wheel 112, spacers 113 and keeper plates 114 is held in place on the sprocket hub 109 by a threaded end cap 115 mounted on an external threaded portion of the sprocket hub 109.

A chain 120 attached to the user handle (not shown) engages the sprocket 112 and is restrained by the keeper plates 114 from jumping off of the sprocket 112. As in the first embodiment, the chain 120 also passes around a second sprocket 121 mounted on the forward bracket assembly 91 and then extends through the hollow horizontal frame member 122 where it is engaged by an elastic cord to urge the chain 120 and the handle to a retracted position. As the handle is pulled outwardly by the user, the chain 120 will rotate the sprocket 112 and that rotation will be imparted to the drive shaft 105 through the one-way clutch 107. When the handle is retracted, the one-way clutch 107 will free wheel and will not impart rotation to the drive shaft 105 which can, however, continue to rotate under the momentum of the flywheel 100. The one-way clutch 107 is preferably a sprague or cam type clutch such as model FSR-5 manufactured by Dana Corp..

The drive shaft 105 also mounts a toothed belt drive sprocket 125 engaged by a toothed belt 126 which also engages a driven belt sprocket 127 keyed to the flywheel shaft 101. The toothed belt 126 will, of course, transmit the rotation of the drive shaft 105 to the flywheel shaft 101 and thence to the flywheel 100.

As in the first embodiment, a magnetic field generator is closely spaced from the outer rim 103 of the flywheel 100. The magnetic field generator includes a field member 130 formed from a stack of laminate plates and a pair of field coils 131 received in spaced notches 132 of the field member 130. The notches 132 divide the field member 130 into three poles of alternating polarity. The field member 130 is bolted to a block 133 of aluminum, or other nonmagnetic material, which in turn spans the space between the side plates 86 and 87 and is held in place by bolts 134 extending through the side plates into the ends of the block 133.

Figure 15:
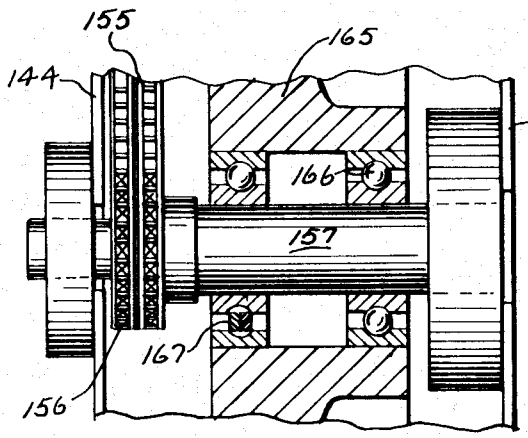
FIG. 15 is a view in section through the flywheel mechanism of the thrid embodiment and taken in the plane of the line 15—15 of FIG. 14.
Figure 14:
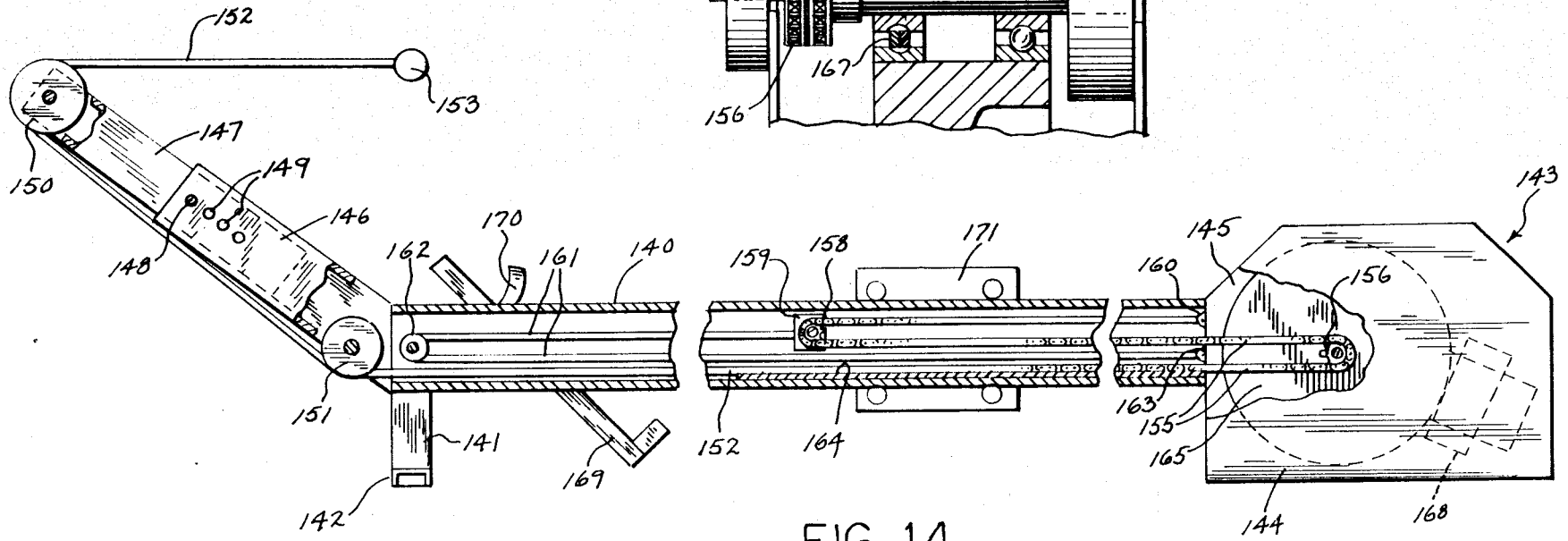
FIG. 14 is a view in elevation of a third embodiment of a rowing exerciser according to the invention.

The embodiment of FIGS. 14 and 15 is similar to the first two embodiments except that it involves driving the flywheel shaft directly from the handle and thereby eliminates a drive between a drive shaft and the flywheel shaft, and the flywheel is mounted at the rear of the horizontal frame. Specifically, a horizontal, hollow tube-like box member 140 is supported at its front on an upright standard 141 which rests on a transverse foot 142. The rear of the horizontal member 140 is supported on a box frame 143 that includes spaced side plates 144 and 145. A front strut assembly is formed of a lower tube member 146 attached to the front of the horizontal box member 140 and an upper strut 147 that telescopes within the lower tube member 146. The position of the upper strut 147 within the lower tube member 146 is adjustable, and the strut 147 can be held in a selected position by inserting a pin 148 in a selected one of a series of holes 149 provided in the lower tube member 146 and corresponding holes provided in the upper strut 147.

The front strut assembly mounts upper and lower pulleys 150 and 151 respectively, which receive a cable 152 attached to a handle 153 to be grasped by the user. The cable 152 extends about the pulleys 150 and 151 and into and through the hollow interior of the horizontal member 140 where it is joined to one end of a double pitch roller chain 155. The chain 155 passes around a double pitch sprocket 156 connected to a flywheel shaft 157 mounted in bearings held in the side plates 144 and 145 of the rear box frame 143. The chain 152 reverses its run and passes around a sprocket 158 on a slide block 159 within the horizontal member 140. The chain 152 reverses once again and the other end of the chain 152 is anchored at a point 160 the rear of the horizontal member 140. The slide block 159 is urged to the left, as viewed in FIG. 14, by a tension cord 161 which extends from the slide block 159 about a front pulley 162 and then returns to an anchor point 163 at the rear of the horizontal member 140. A wear strip 164 is mounted in the bottom of the horizontal member 140 for the distance over which the chain 152 will travel. The wear strip 164 is preferably formed of a lubricant impregnated wood.

A flywheel 165 is mounted to the flywheel shaft 157 by a ball bearing 166 and a combination ball bearing and one-way cam clutch 167, such as the type made by Morse. When the flywheel shaft 157 is rotated in one direction by the chain 152 when the handle is pulled, the clutch 167 will drive the flywheel 165. When the flywheel shaft 157 is rotated in the opposite direction by the retraction of the handle, the flywheel will be disengaged from the flywheel shaft by the free wheeling of the clutch 167.

The third embodiment has a magnetic field generator 168, which is of the same construction as the magnetic field generator of the second embodiment. A pair of foot rests 169 are welded to the outsides of the horizontal member 140, and each has a strap 170. A sliding seat 171 is mounted on rollers to travel along the horizontal member 140.

The third embodiment can be provided with a system of switches actuated by the slide block 159 to control current to the field coils, in the same manner as with the first embodiment.

The double-pitched chain 152 used in the third embodiment has a very small pitch, such as one-quarter inch. The small pitch allows the use of a small diameter socket 156 on the flywheel shaft 157 and thereby permits rotation of the flywheel 165 in the same range of speed as in the first two embodiments. The flywheel speed must operate about a minimum level so that the magnetic field need not be so large and bulky as to make the unit too costly or awkward to use.

In all of the embodiments, the flywheel will typically rotate in an operating range of from 800 to 1200 rpm which would correspond to about 34 strokes per minute. The magnetic field generators and flywheel are designed to provide for increasing torque beyond 1300 rpm, which is the maximum speed likely to be generated by even the most experienced rower. In constrast, a wheel in a bicycle exercise machine is not likely to exceed 240 rpm.

I claim:

1. A rowing exerciser, comprising:

a horizontal frame;

a seat mounted for movement along the frame;

stationary foot rests on the frame;

a flywheel rotatably mounted adjacent the frame;

handle means for rotating the flywheel;

an eddy current brake coupled to the flywheel to resist rotation of the flywheel by the handle means; and said eddy-current brake comprises a nonmagnetic conducting rim on said flywheel and stationary means adjacent said rim for creating a magnetic field through which the rim rotates.

2. A rowing exerciser in accordance with claim 1 wherein said handle means includes a chain attached to a handle, and together with drive means connecting the handle means to the flywheel, said drive means including a sprocket engaged by the chain and connected to a drive shaft, said drive shaft being connected to rotate said flywheel through a one-way clutch.

3. A rowing exerciser in accordance with claim 2 wherein said flywheel is mounted to said one-way clutch and said clutch is mounted on a flywheel shaft that is drivingly connected to said drive shaft.

4. A rowing exerciser in accordance with claim 2 wherein said flywheel is mounted on a flywheel shaft, said sprocket is mounted to said one-way clutch, and said clutch is mounted to said drive shaft which is drivingly connected to said flywheel shaft.

5. A rowing exerciser in accordance with claim 2 wherein the flywheel, drive means and means for creating the magnetic field are mounted between a pair of spaced side plates that enclose the flywheel, drive means and means for creating the magnetic field.

6. A rowing exerciser in accordance with claim 2 together with retraction means connected to said chain and urging said chain to a retracted position with the handle close to said sprocket.

7. A rowing exerciser in accordance with claim 6 wherein said horizontal frame has a front bracket with means for holding the handle while not in use.

8. A rowing exerciser in accordance with claim 2 wherein said sprocket is mounted on a flywheel shaft, and said flywheel is mounted on said one-way clutch that is mounted on said flywheel shaft.

9. A rowing exerciser in accordance with claim 8 wherein said flywheel, said drive means, and said means for creating a magnetic field are mounted at the rear of the frame, said handle is connected to said chain by a cable, said cable passes over pulleys mounted on a strut at the front of said frame.

10. A rowing exerciser in accordance with claim 9 wherein said strut is adjustable to vary the operating height of the handle.

11. A rowing exerciser in accordance with claim 1 wherein said means for creating a magnetic field includes a stationary field member with a field coil connectable to a source of current, said field member having poles of different polarity confronting and spaced slightly from the rim.

12. A rowing exerciser in accordance with claim 11 together with means for adjusting the amount of current delivered to said field coil.

13. A rowing exerciser in accordance with claim 11 wherein said field member has three poles of alternating polarity arrayed along the periphery of the rim.

14. A rowing exerciser in accordance with claim 11 together with means activated by movement of said handle means for disconnecting the current from said field coil during a portion of the return movement of the handle means following a pulling stroke of the handle means.

15. A rowing machine, comprising:

a horizontal member;

a seat movably mounted on the horizontal member;

stationary foot rests mounted to the horizontal member;

a housing at the front of the horizontal member;

means mounted in said housing for creating a magnetic field;

a flywheel journaled in said housing and including a non-magnetic, conducting rim that rotates through said magnetic field;

handle means for rotating the flywheel; and drive means connecting the handle means to the flywheel.

16. A rowing machine in accordance with claim 15, wherein said flywheel is mounted on a flywheel shaft through a one-way clutch, said handle means includes a chain attached to a handle, said drive means includes a sprocket engaged by the chain and mounted on a drive shaft journaled in said housing, and said drive shaft is connected by a drive chain to the flywheel shaft.

17. A rowing machine in accordance with claim 16, wherein said housing is pivotably mounted at the front of said horizontal member so that the height of said sprocket may be varied to adjust the operating height of said handle.

18. A rowing machine in accordance with claim 15, wherein said flywheel is mounted on a flywheel shaft, said handle means include a chain attached to a handle, said drive means includes a sprocket engaged by the chain and mounted to a drive shaft through a one-way clutch, said drive shaft being journaled in said housing, and said drive shaft is connected by a toothed belt to the flywheel shaft.

19. A rowing machine in accordance with claim 18, wherein said housing is pivotably mounted at the front of said horizontal member so that the height of said sprocket may be varied to adjust the operating height of said handle.

20. A rowing machine in accordance with claim 15 wherein said means for creating a magnetic field includes a stationary field member with a field coil connectable to a source of current, said field member having poles of different polarity confronting and spaced slightly from the rim.

21. A rowing machine, comprising:

a horizontal member in the form of an elongated hollow tube, a seat movably mounted on the horizontal member, stationary foot rests mounted to the horizontal member a housing at the rear of the horizontal member, means mounted in said housing for creating a magnetic field, a flywheel journaled in said housing and including a non-magnetic, conducting rim that rotates through said magnetic field, and handle means for rotating the flywheel, said handle means including a cable attached to a handle, upper and lower pulleys mounted on a strut extending from the front of said horizontal member, and said cable passes about the pulleys and into the hollow horizontal member.

22. A rowing machine in accordance with claim 21, wherein said cable is attached to a chain within said horizontal member, said drive means includes a sprocket mounted on a flywheel shaft journaled in said housing, said chain wraps around the sprocket, and said flywheel is connected to said flywheel shaft by a one-way clutch.

23. A rowing machine in accordance with claim 22, wherein said chain is anchored at one end and passes around a sprocket mounted on a slide longitudinally movable within said horizontal member, said slide being connected to a tension means for maintaining the chain taut and to urge the chain and cable to a position in which the handle is retracted toward the strut.

24. A rowing machine in accordance with claim 21, wherein said strut includes means for varying the length of said strut to adjust the height of said upper pulley and thereby adjust the operating level of said handle.

25. A rowing exerciser, comprising:

a hollow horizontal frame;

a seat mounted for movement along the frame;

stationary foot rests mounted to the frame;

a flywheel rotatably mounted adjacent the frame and having a non-magnetic, conducting rim;

means for creating a magnetic field at a position adjacent the flywheel rim, said means including a stationary field member with a field coil connectable to a source of current;

handle means for rotating the flywheel through the magnetic field, said handle means including a handle and a chain that is disposed in said frame and operatively connected to said handle;

a slide block movable within said frame and mounting a sprocket engaging the chain, said slide block being urged to a position in which the handle is retracted toward the front of said frame; and means actuated by said slide block for disconnecting the current from said field coil during a portion of the cycle of movement of the handle.

26. A rowing exerciser, comprising:

a horizontal frame;

a seat mounted for movement along the frame;

stationary foot rests mounted to the frame;

a flywheel rotatably mounted adjacent the frame and having a non-magnetic, conducting rim;

means for creating a magnetic field at a position adjacent the flywheel rim;

handle means including a chain attached to a handle for rotating the flywheel through the magnetic field; and drive means connecting the handle means to the flywheel, said drive means including a sprocket engaged by the chain and connected to a drive shaft, said drive shaft being connected to rotate said flywheel through a one-way clutch, the flywheel, drive means and means for creating the magnetic field being mounted between a pair of spaced side plates that are pivotally mounted to the front of the horizontal frame at one point and an adjustable linkage joins the side plates to the front of the horizontal frame at a point spaced vertically from the pivot point so that the elevation of the sprocket can be adjusted relative to the horizontal frame.

* * * * *

UNITED STATES PATENT OFFICE

CERTIFICATE OF CORRECTION

Patent No. 4,798,378 Dated January 17, 1989

Inventor(s) Robert S. Jones

It is certified that error appears in the above-identified patent and that said Letters Patent is hereby corrected as shown below:

Column 4, line 33, after "disconnect" add ---the flywheel 53 when the handle is retracted.---.

Column 4, line 35, delete ---the flywheel 53 when the handle is retracted.---.

Column 6, line 9, change "fuly" to ---fully---.

Column 6, line 38, change "lower" to ---low---.

Column 9, line 41, change "constrast" to ---contrast---.

Signed and Sealed this

Twenty-fifth Day of July, 1989

*Attest:*

DONALD J. QUIGG

*Attesting Officer*

*Commissioner of Patents and Trademarks*